US011642582B2

(12) United States Patent
Margareten

(10) Patent No.: US 11,642,582 B2
(45) Date of Patent: May 9, 2023

(54) BOXING GAMING DEVICE

(71) Applicant: Bulk Unlimited Corporation, Brooklyn, NY (US)

(72) Inventor: Isamar Margareten, Brooklyn, NY (US)

(73) Assignee: Bulk Unlimited Corporation, Brooklyn, NY (US)

( * ) Notice: Subject to any disclaimer, the term of this patent is extended or adjusted under 35 U.S.C. 154(b) by 258 days.

(21) Appl. No.: 17/137,230

(22) Filed: Dec. 29, 2020

(65) Prior Publication Data

US 2021/0197058 A1 Jul. 1, 2021

Related U.S. Application Data

(60) Provisional application No. 62/954,831, filed on Dec. 30, 2019.

(51) Int. Cl.

| | |
|---|---|
| ***A63B 69/00*** | (2006.01) |
| ***A63B 69/32*** | (2006.01) |
| ***A63F 9/00*** | (2006.01) |
| ***A63B 69/26*** | (2006.01) |
| *A63F 9/24* | (2006.01) |

(52) U.S. Cl.

CPC ..... *A63B 69/32* (2013.01); *A63B 69/26* (2013.01); *A63F 9/0096* (2013.01); *A63B 2220/53* (2013.01); *A63B 2244/102* (2013.01); *A63F 2009/247* (2013.01); *A63F 2009/2408* (2013.01); *A63F 2009/2442* (2013.01); *A63F 2009/2451* (2013.01); *A63F 2300/8029* (2013.01)

(58) Field of Classification Search

CPC ..... A63B 69/32; A63B 69/26; A63B 2220/53; A63B 2244/102; A63F 9/0096; A63F 2009/2408; A63F 2009/2442; A63F 2009/2451; A63F 2009/247; A63F 2300/8029

See application file for complete search history.

(56) References Cited

U.S. PATENT DOCUMENTS

| | | | |
|---|---|---|---|
| 5,346,418 | A | 9/1994 | Arad |
| 5,904,621 | A | 5/1999 | Small et al. |
| 5,984,788 | A | 11/1999 | Lebensfeld et al. |
| 6,302,796 | B1 | 10/2001 | Lebensfeld et al. |

(Continued)

FOREIGN PATENT DOCUMENTS

| | | | | |
|---|---|---|---|---|
| CN | 206167824 U | * | 5/2017 | ..... A63B 69/00 |
| CN | 209612165 U | * | 11/2019 | ..... A63B 69/32 |

(Continued)

*Primary Examiner* — Raleigh W Chiu

(74) *Attorney, Agent, or Firm* — Thorpe North & Western LLP

(57) ABSTRACT

The present invention provides a gaming system for playing a boxing inspired game. The gaming device includes two vests that communicate with each other and keep score via wireless technology. The game is played by two players at a time with the general objective being for a player to hit their opponent's vest as many times as possible within the designated time period. The device allows players to engage in three different modes. Score tracking is announced by audio and does not require any additional devices for viewing the score.

26 Claims, 7 Drawing Sheets

(56) References Cited

U.S. PATENT DOCUMENTS

| | | | | |
|---|---|---|---|---|
| 6,925,851 | B2 * | 8/2005 | Reinbold | A63B 71/06 73/12.09 |
| 7,891,231 | B2 | 2/2011 | Song | |
| 8,469,824 | B1 | 6/2013 | Farley et al. | |
| 8,696,422 | B1 * | 4/2014 | Santiago | A63B 71/10 273/455 |
| 10,390,603 | B2 | 8/2019 | Hinson | |
| 2002/0037759 | A1 * | 3/2002 | Aldridge | A63B 71/12 463/1 |
| 2005/0279004 | A1 | 12/2005 | Woodmansee et al. | |
| 2006/0047447 | A1 * | 3/2006 | Brady | G01P 15/0891 702/41 |
| 2008/0188314 | A1 | 8/2008 | Rosenblum | |
| 2010/0016085 | A1 | 1/2010 | Inoue | |
| 2011/0059675 | A1 | 3/2011 | Liebling et al. | |
| 2012/0279311 | A1 * | 11/2012 | Helmer | F41J 5/041 73/768 |
| 2017/0079329 | A1 | 3/2017 | Zitzke | |
| 2017/0157488 | A1 * | 6/2017 | Migliorati | A63B 71/0605 |
| 2018/0021624 | A1 * | 1/2018 | Cordero | A63B 21/154 601/48 |
| 2018/0133583 | A1 * | 5/2018 | Tran | A63B 43/004 |
| 2018/0353845 | A1 | 12/2018 | Fischer et al. | |
| 2019/0145740 | A1 * | 5/2019 | Czerski | B32B 27/12 2/463 |
| 2019/0321718 | A1 | 10/2019 | Margareten | |
| 2021/0197058 | A1 * | 7/2021 | Margareten | A63F 9/0096 |
| 2021/0316202 | A1 * | 10/2021 | Zillich | A63B 71/145 |

FOREIGN PATENT DOCUMENTS

| | | | | |
|---|---|---|---|---|
| CN | 114712833 | A * | 7/2022 | A63B 69/32 |
| WO | WO-2020041806 | A1 * | 3/2020 | A63B 71/10 |
| WO | WO-2021121459 | A1 * | 6/2021 | A63B 69/004 |

* cited by examiner

BOXING GAMING DEVICE

PRIORITY CLAIM(S) AND RELATED APPLICATION(S)

Priority is claimed to U.S. Provisional Patent Application Ser. No. 62/954,831, filed Dec. 30, 2019, which is hereby incorporated herein by reference.

This is related to U.S. patent application Ser. No. 29/743,329, filed Jul. 21, 2020, which is hereby incorporated herein by reference.

BACKGROUND OF THE INVENTION

1. Field of the Invention

This invention relates to a boxing game system; and more particularly relates to wearable vests that interact with sensors controlled by wireless technology for the purpose of tracking, and score keeping, and providing feedback during multiple game modes based on different patterns.

2. Description of the Related Art

Boxing is a popular, competitive sport with its origins dating back to ancient times. In modern times, a boxing match consists of two people, known as boxers, wearing protective gloves and throwing punches at each other for a predetermined amount of time. Professional boxing matches are overseen by a referee over a series of one-three-minute intervals known as rounds. The result of the match is decided when an opponent is deemed incapable to continue by a referee, is disqualified for breaking a rule, or resigns on their own. The ultimate goal is to inflict the most amount of punches on your opponent.

SUMMARY OF INVENTION

It is one of the main objectives of the present invention to provide a boxing inspired gaming device that provides feedback and motivation to the users.

It is still another objective of the present invention to provide a gaming device which keeps score and tracks rounds.

It is still another objective of the present invention to provide a gaming device which allows a player to engage in different modes.

It is still another objective of the present invention to provide a device in which the chest gear unit is portable to carry, inexpensive to manufacture, and convenient to use.

Further objectives of the invention will be brought out in the following part of the specification, wherein detailed description is provided for the purpose of fully disclosing the invention without placing limitations thereon.

BRIEF DESCRIPTIONS OF THE DRAWINGS

With the above and other related objectives in view, the invention consists in the details of construction and combination of parts, as will be more fully understood from the following description, when read in conjunction with the accompanying drawings in which.

DETAILED DESCRIPTION OF THE EMBODIMENTS OF THE INVENTION

Figure 1:
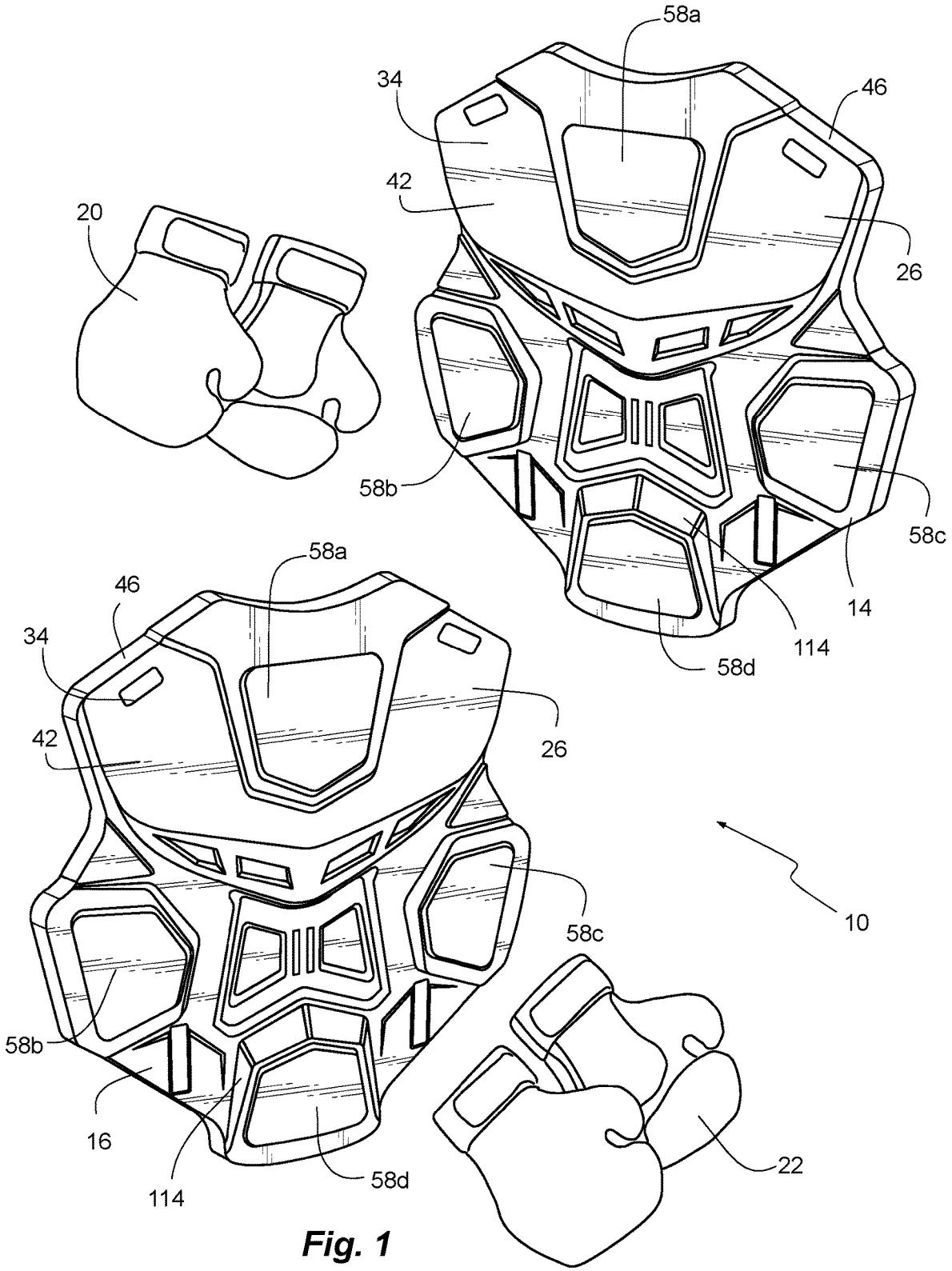
FIG. 1 is a schematic perspective view of a boxing game system in accordance with an embodiment of the present invention.
Figure 2:
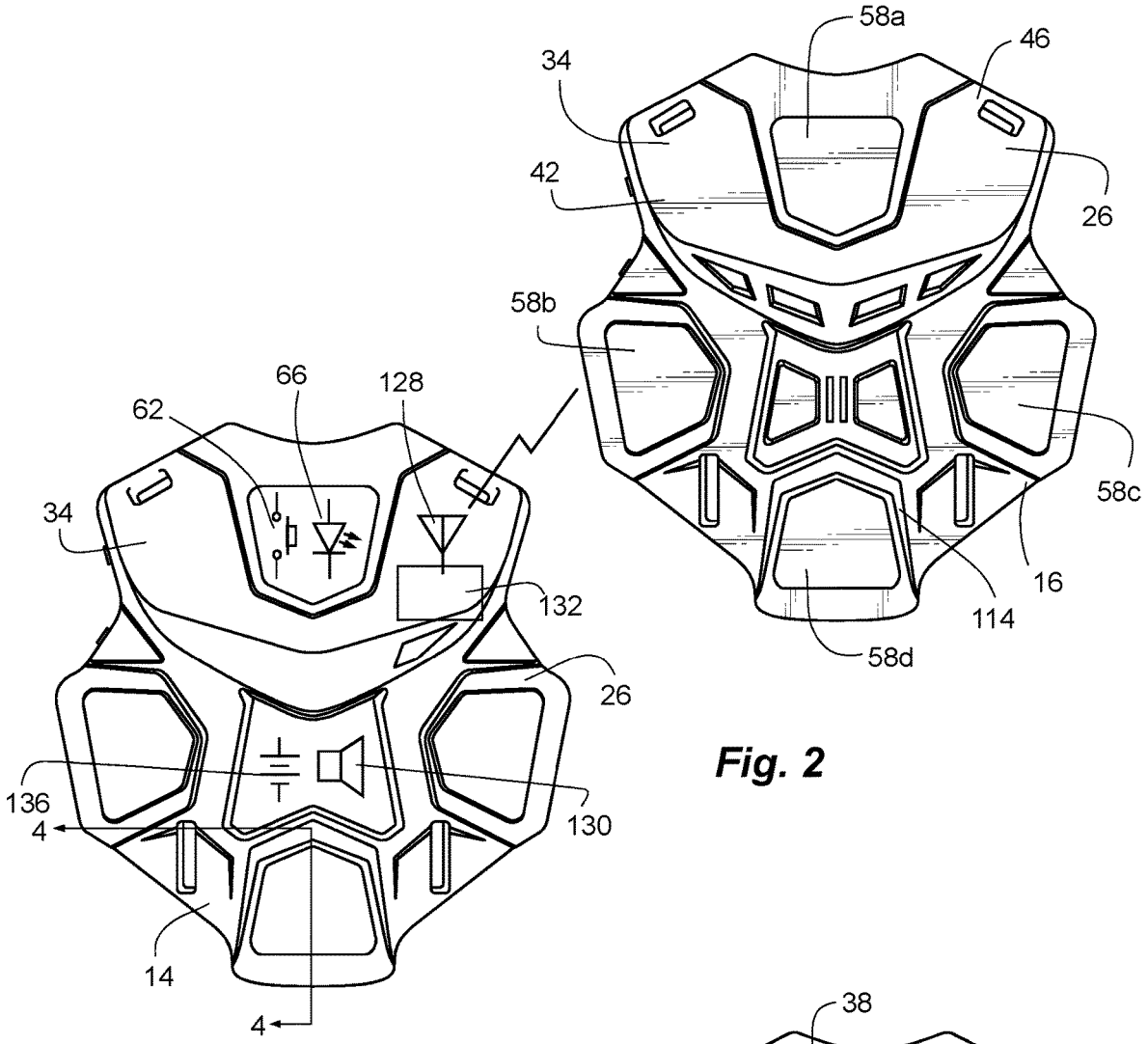
FIG. 2 is a schematic front view of the boxing game system of FIG. 1, showing a pair of wearable vests and breast plates wirelessly pairing with one another.
Figure 4:
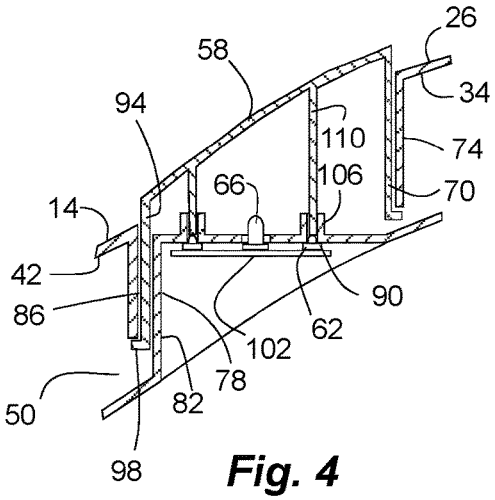
FIG. 4 is a partial side cross-sectional view of the wearable vest and the breast plate of the boxing game system of FIG. 1, taken along line 4 of FIG. 2.
Figure 3:
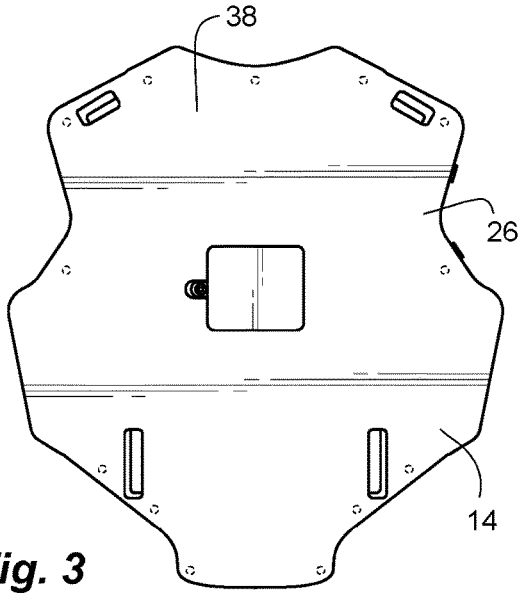
FIG. 3 is a rear view of a wearable vest and a breast plate of the boxing game system of FIG. 1.
Figure 5:
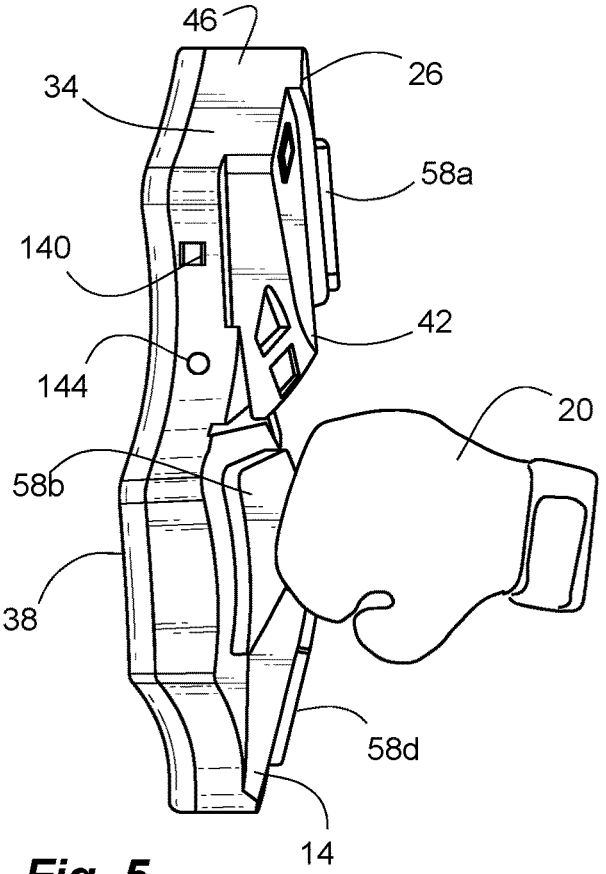
FIG. 5 is a right-side schematic view of the wearable vest and the breast plate of the boxing game system of FIG. 1.
Figure 6:
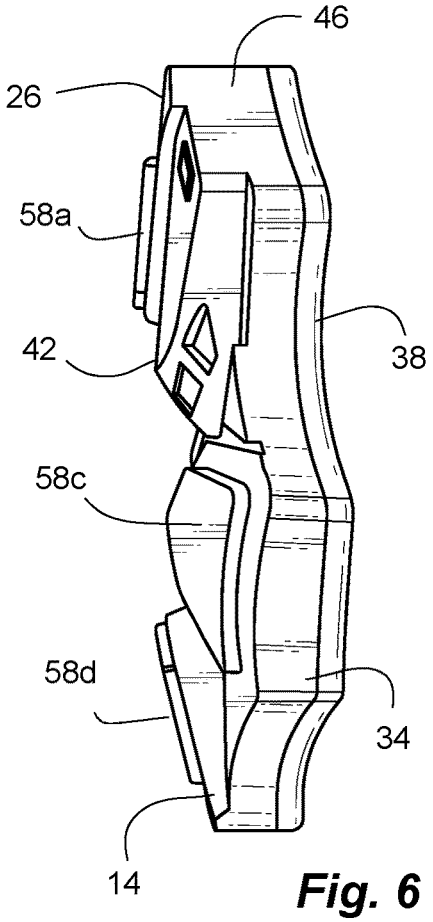
FIG. 6 is a left-side view of the wearable vest and the breast plate of the boxing game system of FIG. 1.
Figure 7:
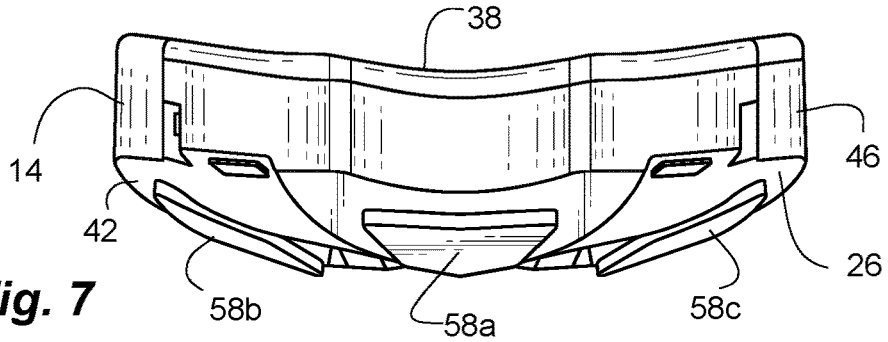
FIG. 7 is a top view of the wearable vest and the breast plate of the boxing game system of FIG. 1.
Figure 8:
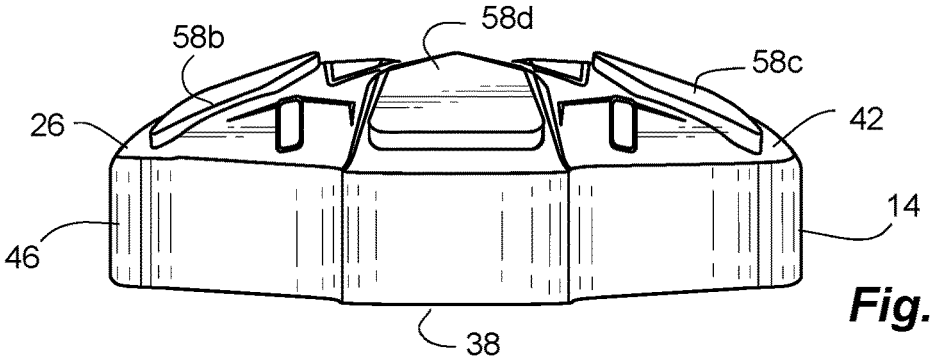
FIG. 8 is a bottom view of the wearable vest and the breast plate of the boxing game system of FIG. 1.
Figure 9:
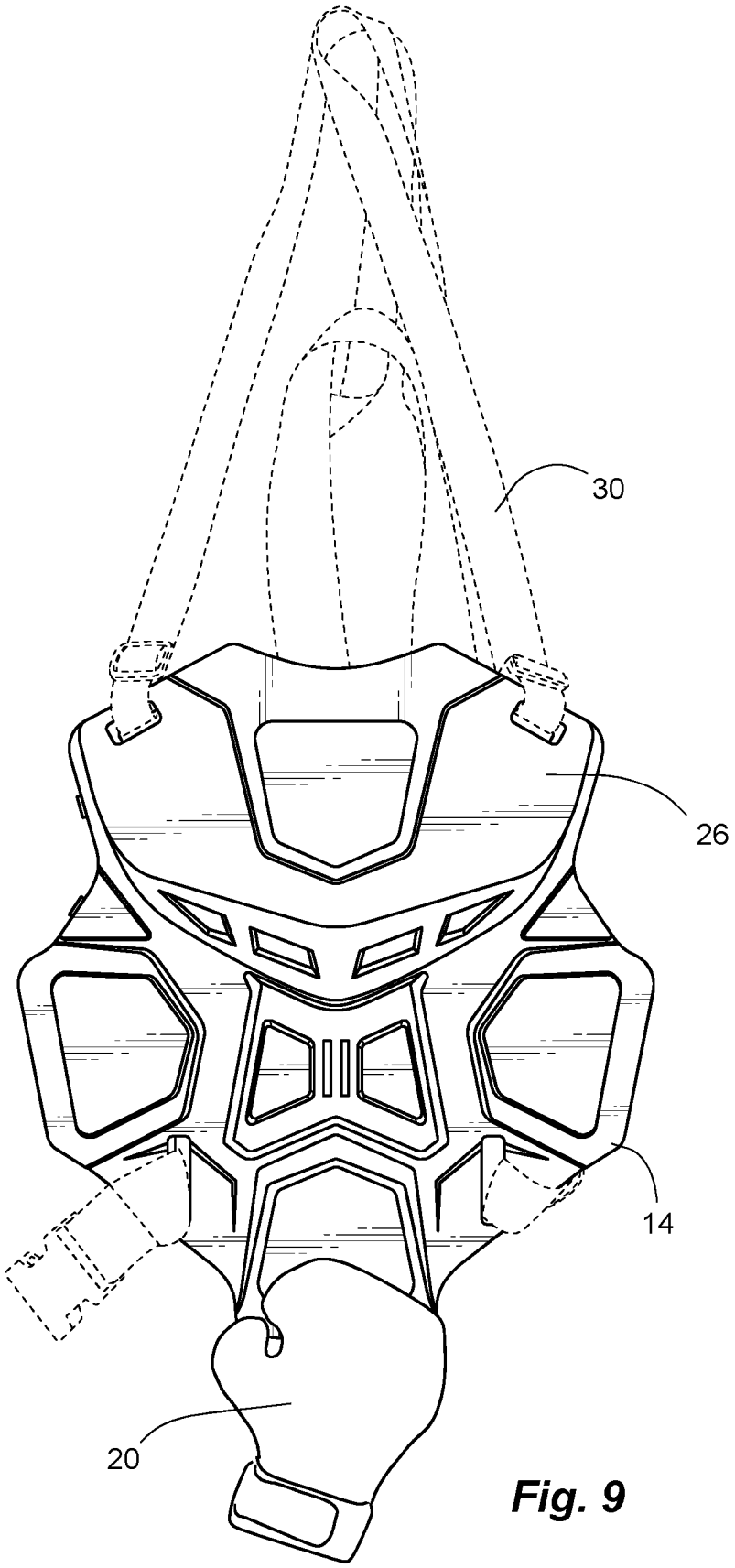
FIG. 9 is a front schematic view of the wearable vest and the breast plate of the boxing game system of FIG. 1.
Figure 10:
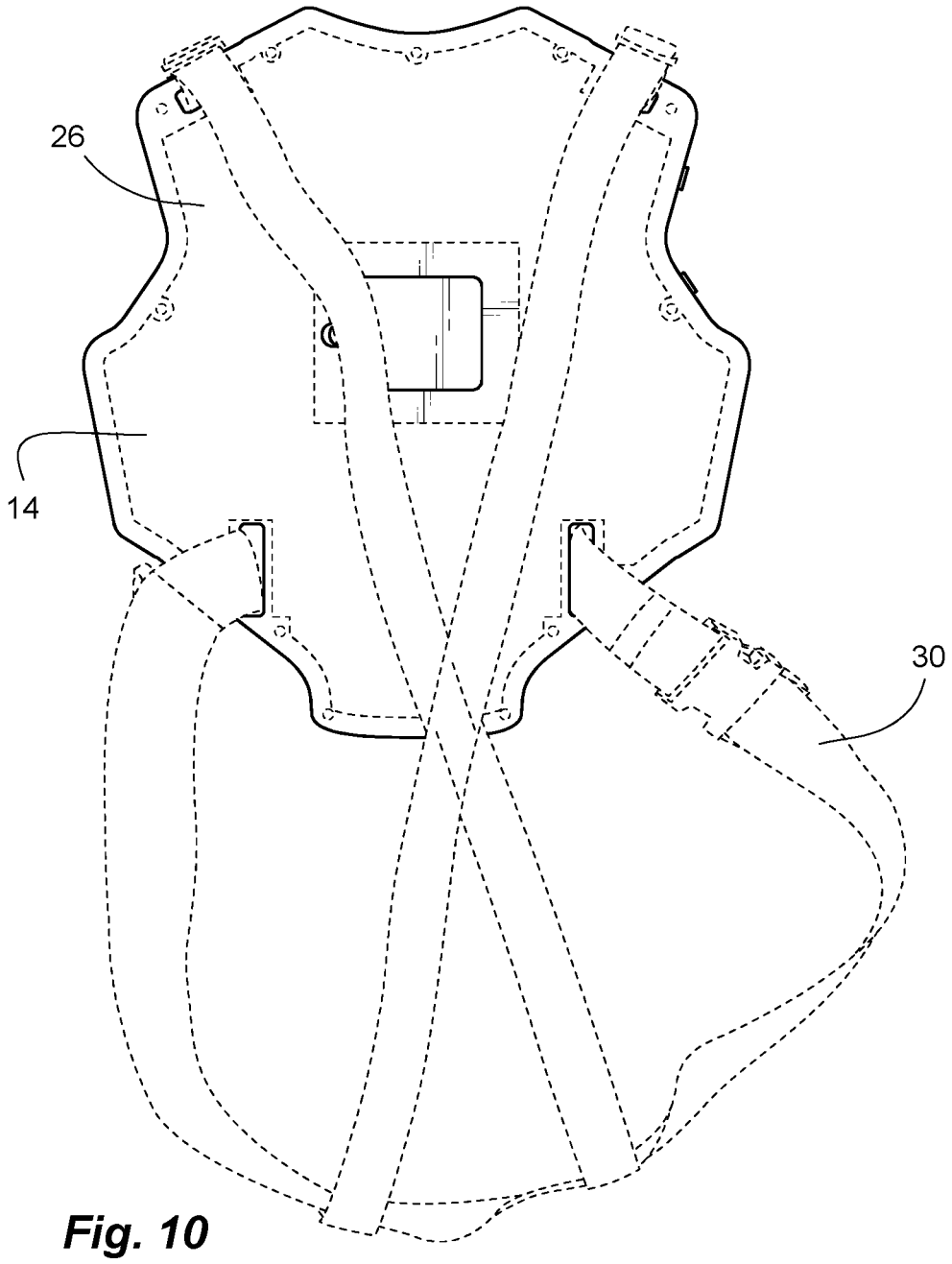
FIG. 10 is a rear view of the wearable vest and the breast plate of the boxing game system of FIG. 1.

Illustrative embodiments of the present invention are described below. The following explanation provides specific details for a thorough understanding of and enabling description for these embodiments. One skilled in the art will understand that the invention may be practiced without such details. In some instances, well-known structures, processes, and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

The boxing game system is configured for facilitating a game evoking elements of a boxing match. The boxing game system generally includes two wearable vests and two sets of boxing gloves. The game is played by two players at a time with the general objective being for a player to hit their opponent's vest as many times as possible within the designated time period. The vests wirelessly pair to one another to coordinate game play. In one embodiment, one of several games can be selected to be played by two or more players at a time with the general objective being for a player to hit their opponent's vest as many times as possible within the designated time period. The device allows players to engage in a plurality of different modes. Score tracking can be announced by audio and does not require any additional devices for viewing the score. The vests are configured to interact with each other. When a player hits an opponent's vest, audio may be played in response to the hit on one or both of the player and the opponent's vests. The interaction and communication between the vests creates a realistic gaming experience that enhances training regimens and entertainment. While examples are provided for the system to be used to train and simulate boxing matches, this is not intended to be limiting. The boxing game system can be used for a variety of different combat simulations, such as various forms of martial arts. Two or more players can wear the vests while training for any type of combat that can involve contacting an opponent at specific locations.

Referring to FIGS. 1-10, a boxing game system 10 is shown in accordance with an example of the invention. The system 10 comprises a pair of wearable vests, namely first and second wearable vests 14 and 16. The system 10 can also comprise two sets of boxing gloves, namely first and second pairs of boxing gloves 20 and 22.

In one aspect, the vests 14 and 16 can be identical. Thus, a single vest 14 will be described with the understanding that such description applies to the other vest 16. The vest 14 can comprise a breast plate 26 and a set of straps 30 (FIGS. 9 and 10) to attach the breast plat to a person's torso. The breast plate 26 can be sized to cover the person's torso. The breast plate 26 can be rigid and can have a rigid housing 34 or shell. The rigid housing 34 or shell can comprise a back wall 38, a front wall 42 spaced-apart from the back wall 38, and a perimeter wall 46 extending between the front and back walls 42 and 38 transverse to a front of the breast plate 26. A hollow interior 50 can be defined in the housing 34. In one aspect, the housing 34 can be formed of plastic and can be formed by injection molding. In another aspect, the straps 30 can be nylon webbing. The housing 34, and the front and back walls 42 and 38, can have slots therethrough to receive the straps 30. In another aspect, the back wall 38 can carry a padding, such as a foam layer.

The breast plate 26, and the vest 14, can also comprise a plurality of lightable target pads 58. The lightable target pads 58 can include a sensor 62 to sense strikes against the pad by the boxing glove, and a light 66 to indicate which target pad to strike, as discussed in greater detail below. In one aspect, the lightable target pads 58 can be at least light translucent so that they may be illuminated by the light 66. In another aspect, the lightable target pads 58 can comprise: a first lightable target pad 58*a* in an upper middle region on a front of the breast plate 26; a second lightable target pad 58*b* in a left center region on the front of the breast plate 26; a third lightable target pad 58*c* in a right center region opposite the second lightable target pad on the front of the breast plate 26; and a fourth lightable target pad 58*d* on a bottom middle region opposite the first lightable target pad on the front of the breast plate 26. Thus, the breast plate 26 can be covered by the target pads 58 and with target pads 58 across the breast plate 26. In one aspect, the target pads 58 can be sized relative to a knuckle portion of the boxing gloves 20 and 22. In another aspect, the target pads 58 can form buttons to provide input to the controller and select games.

In one aspect, the target pads 58 can be displaceable with respect to the breast plate 26, and the front wall 42, and can be depressed inwards toward the front of the breast plate 26. The sensor 62 can be activated when the target pad 58 is depressed by one or more of a hand, a foot, or a boxing glove. The target pad 58 can be biased outwardly away from the front of the breast plate 26. In another aspect, the target pads 58 can be deformable.

In one aspect, an aperture 70 (FIG. 4) can be formed in the breast plate 26 and substantially covered by the target pad 58. The aperture 70 can be substantially circumscribed by a perimeter wall 74 transverse to the breast plate 26. The perimeter wall 74 can have an interior end. The transvers perimeter wall 74 can provide strength to the breast plate 26 around the target pats 58 to resist damage from strikes. A retainer 78 can be secured to the breast plate 26 and the front wall 42 behind the aperture 70 and the target pad 58. In one aspect, the retainer 78 can substantially cover the aperture 70. The retainer 78 can have a perimeter wall 82 parallel to and spaced-apart from the perimeter wall 74 of the aperture 70 and defining a perimeter gap 86 therebetween. The perimeter gap 86 can be annular and can circumscribe the target pad 58.

The retainer 78 can carry the sensor 62 so that the sensor is positioned behind the target pad 58. In one aspect, the sensor 62 can be at least one switch contactable by the target pad 58. In addition, the retainer 78 can carry at least one spring or bias member 90 to bias the lightable target pad 58 away from the sensor 62 and the switch. Furthermore, the retainer 78 can carry the light 66 so that the light is positioned behind the target pad 58. In one aspect, the target pads 58 can be at least light translucent to be illuminated by the light 66. In one aspect, the light can be an LED to resist damage from impacts on the target pad 58.

The target pad 58 can have a perimeter wall 94 movable in the perimeter gap 86 between the retainer 78 and the aperture 70. Thus, the perimeter gap 86 can form a track for displacement of the target pad 58 and the perimeter wall 94 thereof. In addition, the target pad 58 can have a flange 98 circumscribing the perimeter wall 94 and sized larger than the aperture 70 so that the flange 98 abuts to the interior end of the perimeter wall 74 of the aperture 70 to retain the target pad 58 in the breast plate 26. In one aspect, the sensor 62 or switch, the light 66 and the bias member 90 can be carried by a circuit board 102 that is carried by the retainer 78. In another aspect, the retainer 78, the sensor or switch 62, the bias member 90, and the light 66 can be separate and discrete from other target pads 58 to isolate impact forces to one target pad from the other target pads.

In another aspect, a sleeve 106 can be carried by the retainer 78, and thus the breast plate 26, behind the target pad 58. The sensor 62 or switch can be positioned at a bottom of the sleeve 106. Similarly, the bias member 90 can be positioned in the sleeve 106. A post 110 can be carried by the target pad 58 and movably received in the sleeve 106. The post 110 can contact the sensor 62 or switch when the target pad 58 is struck, while being biased away from the sensor 62 or switch by the bias member 90. In one aspect, the bias member 90 an be an elastomeric member with a perimeter flange secured to the circuit board or the retainer 78, and a bulbous head projecting into the sleeve 106 and over the sensor 62 or switch.

In another aspect, the breast plate 26 can have a plurality of raised panels 114 protruding therefrom and associated with the target pads 58. The raised panels 114 can circumscribe the respective target pad 58. The apertures 70 can be formed in the raised panels 114. The raised panels 114 can located the target pads 58 outward from the breast plate 58 and position the target pads 58 for easier contact. In another aspect, the target pads 58 can be oriented transverse to one another and to face outwardly with respect to a middle of the breast plate 26. Thus, the target pads 58 can be oriented for easier contact.

In another aspect, the target pads can be deformable target pads to allow the target pad to be deformed inwards towards a front of the breast plate. The sensor can be activated when the deformable target is deformed by one or more of a hand, a foot, or a boxing glove.

Each vest 14 and each breast plate 26 also comprise a wireless transceiver 128 coupled to a controller 132 to wirelessly communicate with one another. In one aspect, the vests 14 and 16, and the controllers 132 thereof, can communicate via the wireless transceivers 128 utilizing wireless standards, such as WiFi, Bluetooth, Zigbee, or another desired standard. In another aspect, the controllers 132 can pair with a smart phone. The controller 132 and the wireless transceiver 128 can be disposed in the housing 34. The sensor 62 or switch and the light 66 can also be coupled to the controller 132. A power supply 136, such as a battery supply, can be located in the housing 34 and coupled to the controller 132. The power supply 136 can power the transceiver 128, the controller 132, and the light 66 for each lightable target pad 58. An audio speaker 130 can be located in the housing 34 and coupled to the controller 132. A power switch 140 can be mounted on the perimeter wall 46 of the housing 34 and coupled to the power supply 136 to turn power on and off to the breast plate 26 and the vest 14. A volume button 144 can also be mounted on the perimeter wall 46 of the housing 34 and coupled to the controller 132.

As described above, the vest 14 can be a first vest 14 with a first wireless transceiver 128; a first controller 132 coupled to the first wireless transceiver 128; a first breast plate 26 having a first plurality of lightable target pads 58, a first plurality of sensors 62 or switches coupled to the first controller 132; a first plurality of lights 66 coupled to the first controller 132; a first audio speaker 130 coupled to the first controller 132; and a first set of straps 30 coupled to the first wearable vest 14. Similarly, the vest 16 can be a first vest 16 with a second wireless transceiver 128; a second controller 132 coupled to the second wireless transceiver 128; a second breast plate 26 having a second plurality of lightable target pads 58, a second plurality of sensors 62 or switches coupled to the second controller 132; a second plurality of lights 66 coupled to the second controller 132; a second audio speaker 130 coupled to the second controller 132; and a second set of straps 30 coupled to the second wearable vest 14. The first controller 132 of the first wearable vest 14 is configured to communicate with the second controller 132 of the second wearable vest 16 via the first wireless transceiver 128 and the second wireless transceiver 128, respectively.

In use, one of the first controller or the second controller 128 can activate a predetermined game when a sensor 62 or switch of the selected lightable target pad 58 is activated. The predetermined game can be a first game activated by the first controller 128 at the first wearable vest 14. The first controller 132 can activate a light 66 in each of the first lightable target pads 58 in the first wearable vest 16. The first controller 132 can also activate a timer at the first wearable vest 16. The first controller 132 can also divide the first game into a plurality of rounds using the timer. The first controller 132 can also detect when each of the sensors 62 or switches coupled to the lightable target pads 58 in the first wearable vest 14 are deactivated and turn off a corresponding light 66 in the lightable target pad 58 for a selected period of time using the timer. The first controller 132 can also play an identified sound on a speaker 132 of the first wearable vest 14 based on which of the first lightable target pads 58 are depressed, and a number of the first lightable target pads 58 that have been depressed on the first wearable vest 14 within a selected time period. The first controller 132 can also send a selected indication to the first wireless transceiver 128 for communication to the second controller 132 via the second wireless transceiver 128, to enable the second controller 132 to perform a selected function at the second wearable vest 16 based on the selected indication. The selected indication is determined based on which of the first lightable target pads 58 is depressed, and a number of the first lightable target pads 58 that have been depressed on the first wearable vest 14 within the selected time period. The selected function can comprise playing an identified sound in a speaker 130 of the second wearable vest, wherein the sound is identified based on the selected indication.

In one example, pairing can be established after both vests are powered on and the same game mode is selected on both vests. If a different mode is selected in one of the vests, then vests will not pair. When the vests are not paired, then the controller in each vest can be configured to provide an audio statement through the audio speaker 130. For example, the audio speaker 130 can play preprogrammed audio such as "waiting to pair" at both vests. The user can either power on/off the vests or push the volume/score button. This can cause the controller to provide another pre-programmed audio statement, such as "tap a light to select a game" or "select a game". This will allow the user(s) to select a game that matches the other vest. Once the same game has been selected, the vests will pair and communicate throughout the game. The preprogrammed audio statements are provided as examples. They are not intended to be limiting. The actual preprogrammed audio can be selected to meet the needs of the users, including but not limited to providing the audio in different languages or providing different audio in response to actions performed on the vests.

In one aspect, the first and second wearable vests 14 and 16 can have at least three modes of operation, comprising: a boxing mode, a target mode and a training mode. The target mode can also be referred to as an advanced mode. In the boxing mode, all of the first and second plurality of lightable target pads 58 are lit but turn off when hit and then relight after a predetermined time period. In the target mode, each first and second plurality of lightable target pads 58 are lit individually and sequentially, or randomly, until hit, or until a predetermined time period, or both. In the training mode, all of the first and second plurality of lightable target pads 58 are lit but turn off when hit and then relight immediately.

The system 10 can be provided as a kit with a pair of vests 14 and 16, two sets of boxing gloves 20 and 22, and instructions, all packaged in a container. A method for using the boxing game system 10 can comprise: instructing to don the first and second wearable vests 14 and 16; instructing to turn on each of the first and second wearable vests 14 and 16; and instructing to pair the first and second wearable vests 14 and 16 by instructing to select a game by instructing to press one of the first plurality of lightable target pads 58 on the first breast plate 26 and a same lightable target pad 58 on the second breast plate 26.

In order to start a game, both players turn on their vests 14 and 16 within a set amount of time by flipping the power switch 140 on the side of the vest. At such time, the player will be prompted to select a gaming mode by the vest 14 or 16 playing one of the pre-programed sounds, such as, "tap a light to select a game." Players have different games to choose from, including a boxing game, a target or advanced game and a training game. Players can select the game they wish to play by pressing the corresponding target pad 58*a*, 58*b* or 58*c*, which may be lit by the light 66. The upper middle target pad 58*a*, the left center target pad 58*b*, and the right center target pad 58*c* can each correspond to a different game.

After turning on the device, the player will push one of the target pads 58*a*, 58*b* or 58*c* to select a game. In one embodiment of the invention, if a player hits the upper middle target pad 58*a*, the controller 132 of the vest 14 says through the audio speaker 130 "boxing mode, be the first to knock out all your opponent's lights", and the controller 132 of the vest 14 connects via the transceiver 128 to the controller 132 of their opponent's vest 16. At such point the vests 14 and 16 are paired, and the players are ready to start playing the boxing game. In this mode, there are a certain number of rounds, such as five. A different song is played by the controller 132 through the audio speaker 130 during each of the rounds. In one embodiment of the game, the first four rounds are set for a designate amount of time, such as one and a half minutes. The final round does not have a set amount of time but rather continues until one of the players wins by striking all of the target pads 58.

In another embodiment, the vests 14 and 16 can be configured to pair prior to each vest selecting the same mode. For example, a first vest 14 can be configured to pair with a second vest 16 when the second vest is activated (i.e. turned on) within a selected distance of the first vest. The selected distance is determined based on the distance that the transceiver 128 can communicate effectively with the transceiver in another activated vest. Since the vests are configured to be used within a close proximity for activities such as boxing and martial arts, the selected distance can be relatively short, such as within 50 feet or less. Alternatively, the use of wireless standards such as Bluetooth or WiFi can allow the vests to pair over a longer range based on the operating range of the wireless standard.

In one embodiment, each vest can be configured to communicate over multiple carrier frequencies, such as 2, 3, 4, or more carrier frequencies. Each vest can include a switch that enables a user to select a carrier frequency. When two or more vests operating on the same carrier frequency are turned on, the vests can be configured to pair. This enables multiple groups of vests to be used within the same proximity, such as in a boxing gym, a home, or another desired geographic location.

While examples have been provided for two vests 14, 16 to be used, this is not intended to be limiting. Three, four, or more vests may be configured to pair and operate simultaneously. Each group of vests can be switched to operate at the same operating frequency. Multiple groups of vests can be configured to operate within a proximate distance, such as within the selected distance of 50 feet, by setting the different groups to operate at different carrier frequencies.

At the start of the boxing mode game, all four of the target pads 58 are lit and illuminated. When a target pad 58 is hit, the light 66 associated with the target pad 58 is turned off. The goal of the boxing mode game is to hit all four target pads 58 on your opponent's vest 14 or 16 so that all four lights 66 associated with the target pads 58 are turned off. If a player hits a target pad 58 on their opponent's vest 16 but fails to hit another target pad 58 after a certain amount of time has passed, the light 66 of the target pad 58 that the player hit gets turned back on. The amount of time a player has to hit another target pad 58 depends on the round and the amount of time players have to hit another target pad increases as the players advance rounds.

When a player hits their opponent's vest 16 so that one of the lights 66 of the target pads 58 is turned off, the controller 132 of their vest 14 plays preprogramed audio through the audio speaker 130, such as "good hit" and the controller 132 of the opponent's vest 16 that got hit will play a sound through the audio speaker 130, such as "ow." When a player hits their opponent's vest 16 so that two of the lights 66 of the target pads 58 are turned off, the controller 132 of their vest 14 plays preprogramed audio through the audio speaker 130, such as "great job" and the controller 132 of the opponent's vest 16 that got hit will play a sound through the audio speaker 130, such as "ouch." When a player hits their opponent's vest 16 so that three of the lights 66 of the target pads 58 are turned off, the controller 132 of their vest 14 plays the preprogramed audio through the speaker 130, such as "finish it" and the controller 132 of the opponent's vest 16 that got hit will play a sound through the speaker 130, such as "one more life." When a player hits their opponent's vest 16 so that the lights 66 of all four target pads 58 are turned off, the controller 130 of their vest 14 plays preprogramed audio through the speaker, such as "crowd cheers" and the controller 132 of the opponent's vest 16 that got hit will play a sound through the speaker, such as "game over" and at such time the game is over. If there is no winner in a given round, the players will move on to another round until a winner is declared. In boxing mode, whoever knocks out all their opponent's target pads 58 first wins the entire game.

In another embodiment of the invention, a player could hit another target pad 58, such as the left center target pad 58*b* to activate another game mode, such as a training mode. At this time the controller 132 of the vest 14 would play preprogramed audio through the speaker 130, such as "training mode, get ready for a match, the higher score wins" and connects via the transceivers 128 to the controller 132 of their opponent's vest 16. At such point the two vests 14 and 16 are paired, and the players are ready to start playing the training or target game. In this mode, there is only one round that lasts for a certain amount of time, such as three-minutes. During this time, the lights 66 of all four target pads 58 are lit up and players try to hit their opponents vest as many times as possible. If one of the target pads 58 gets hit, the controller 132 will play a sound through the speaker 130 and the light 66 will turn off for two seconds and then turn back on.

When a player hits their opponent's vest 16 so that the light 66 of one of the target pads 58 is turned off, the controller 132 of their vest 14 plays the preprogramed audio through the speaker 130, such as "good hit" and the controller 132 of the opponent's vest 16 that got hit will play a sound through the speaker 130, such as "ow." When a player hits their opponent's vest 16 so that the lights 66 of two of the target pads 58 are turned off, the controller 132 of their vest 14 plays the preprogramed audio through the speaker 130, such as "great job" and the controller 132 of the opponent's vest 16 that got hit will play a sound through the speaker 130, such as "ouch." At the end of the three-minute round, the controller 132 of each vest 14 and 16 will play the score of that player through the speaker 130. A player's score is the number of times they hit their opponent's vest. Whichever player hits their opponent's vest the most wins the game. After announcing the score, the controller of the vest 14 of the winning player will play audio through the speaker 130 to designate that they have won, such as "winner." The controller 132 of the other player's vest 16 will play audio through the speaker 130 to designate that they have lost the game, such as "loser." Additionally, during this training mode, players can press the volume button 144 at any time to get the score for the current game.

In another example, the volume button 144 can be configured to be depressed by a user for a selected period of time. The volume button can be configured to operate in each of the vest's modes. The controller can be configured to perform an action after the selected period of time. For instance, when the volume button 144 is depressed for a time, such as 3 seconds, the speaker 130 can play a preprogrammed audio of "low volume". If the volume button 144 is depressed again for 3 seconds, the preprogrammed audio of "high volume" can be played on the speaker 130. Accordingly, in this example, the controller can be configured to alternate between a "low audio" setting and a "high audio" setting for the boxing system when the volume button is depressed for a selected period of time. The level of the volume for each setting can be predetermined.

In another example, the volume button 144 can be configured to send a signal from the controller to the speaker 130 to play a preprogrammed audio of the score of the game being currently played. The score can be played when the volume button 144 is depressed for less than the selected period of time. For example, when the volume button 144 is depressed for less than 3 seconds, then the speaker 130 can play the score of the current game.

In another embodiment of the invention, a player could hit one of the target pads 58, which could be the right center target pad 58*c*, to activate another game mode, such an advanced or target mode. At such time the controller 132 of the vest 14 would play preprogramed audio through the speaker 130, such as "advanced mode, hit the lights as they appear" and the controller 132 would connect via the transceivers 128 to the controller 132 other vest 16. At such point the vests 14 and 16 are paired, and the players are ready to start playing the advanced or target game. The vests may be paired by selecting the same game mode on each vest. Alternatively, the vests may be paired by turning on the vests with the same carrier frequency selected.

In the advanced game mode, there is only one round that continues until one of the players wins. A player wins by scoring a certain amount of points, such as ten points. During this mode, only one light 66 of one target pad 58 on a players' vest 14 or 16 is lit up at a given time. The lights 66 will turn on one-by-one at random for three seconds. The player's objective for this mode is to hit the illuminated target pad 58 on their opponent's vest 16. Players only get points for hitting the illuminated target pad 58. Players do not receive any points for hitting non-illuminated target pads 58. If a player hits the illuminated target pad 58, they get a point and a sound effect is played. When a player hits an illuminated target pad 58 on their opponent's vest 16 for the first time, the controller 132 their vest 14 plays preprogramed audio through the speaker 130, such as "good hit" and controller 132 of the opponent's vest 16 that got hit will play a sound through the speaker 130, such as "ow." When a player hits an illuminated target pad 58 on their opponent's vest 16 for a second time, the controller 132 of their vest 14 plays the preprogramed audio through the speaker 130, such as "great job" and the controller 132 of opponent's vest 16 that got hit will play a sound through the speaker 130, such as "ouch." When a player hits an illuminated target pad 58 on their opponent's vest 16 for a tenth time, the controller 132 of their vest 14 plays audio through the speaker 130 to indicate they have won the game, such as "crowd cheers." The controller 132 of the opponent's vest 16 that got hit ten times will play a sound through the speaker 130 to indicate they lost the game, such as "game over."

Figure 11:
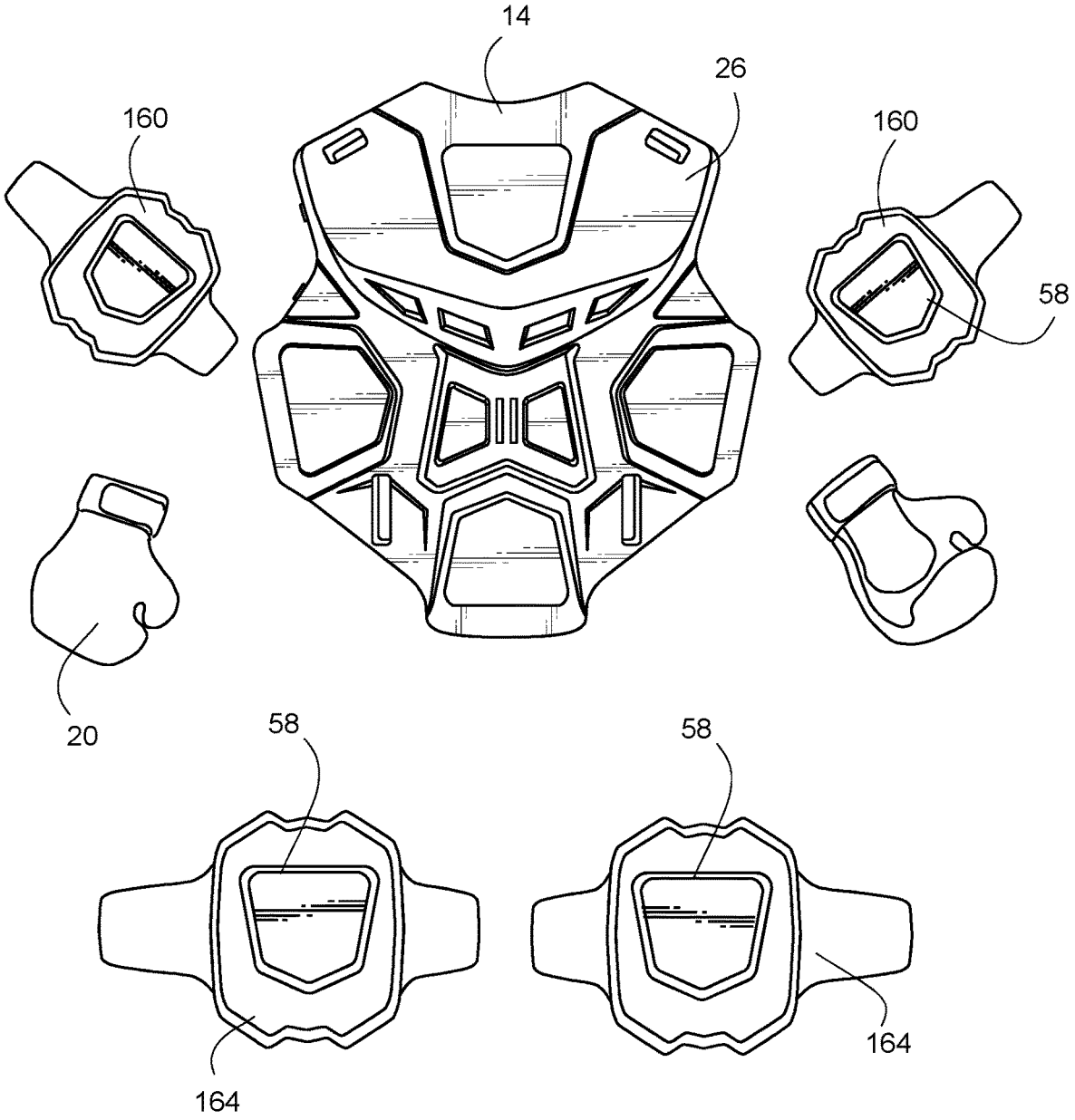
FIG. 11 is a schematic front view of another boxing game system in accordance with another embodiment of the present invention.

In another aspect, the system can further comprise shield accessories to the vests 14, 16. The shield accessories can include arm shields 160 and/or leg shields 164, as illustrated in FIG. 11, that are similar in many respects to the vests 14 and 16 and the breast plates 26 described above. The arm shields 160 and/or leg shields 164 can provide additional contact points enabling them to be used with the vests 14, 16 for practicing multiple types of sports, such as boxing and martial arts.

Figure 12:
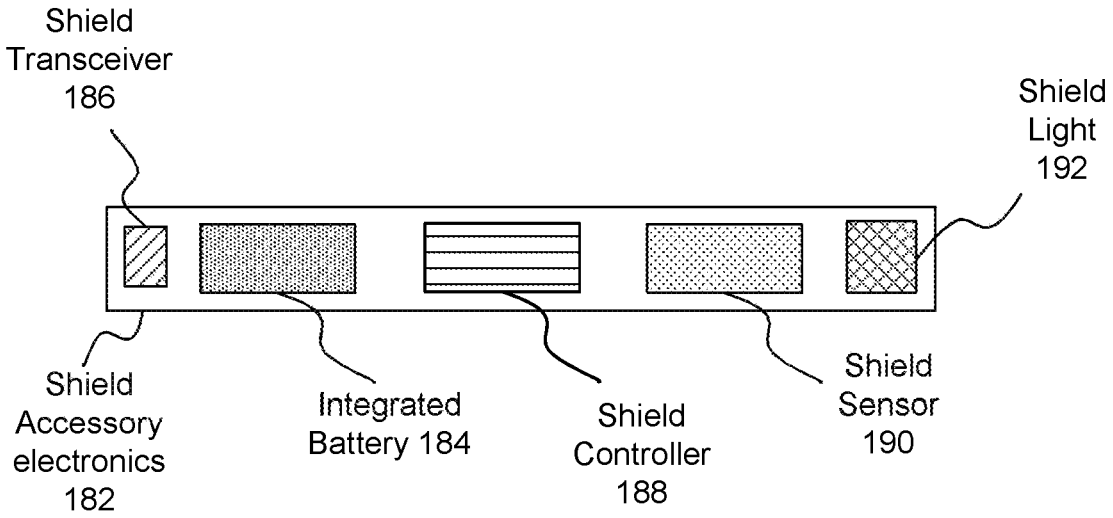
FIG. 12 is an illustration of electronic elements of a shield accessory in accordance with an embodiment of the present invention.

The arm shields 160 and/or leg shields 164, referred to as shield accessories, can be worn on the upper arms and/or thighs, respective. The arm shields 160 and/or leg shields 164 can provide target pads 58 as described above and can have controllers 188 and transceivers 186 to pair with and communicate with the controllers 132 and transceivers 128 of their respective vest 14 and breast plate 26. Each shield accessory can include one or more of the electronic elements 182 displayed in the example of FIG. 12. The shield accessory electronics 182 can be comprised of the same or different electronic elements as those used in the vest 14 (i.e. controller 132, light 66, sensor 62, power supply 136, and wireless transceiver 128). The shield accessory electronics 182 may be combined on a single circuit board, multiple circuit boards, and/or may be fastened within the arm shield 160 and/or leg shield 164 structures as discrete components. The shield accessory electronics 182 can be powered by a power supply, such as a battery 184 that is integrated within the shield accessory. The battery can be located within a removable cover of the shield accessory to enable a user to replace the battery.

In one embodiment, the arm shields 160 and leg shields 164 can include shield lights 192 coupled to shield sensors 190 or shield controllers 188 in the arm shield and leg shield structures. The shield lights 192 can be turned on and off by the shield controller 188 when the target pads 58 on the arm shields 160 or leg shields 164 are contacted or depressed by a user or an opponent, as detected by the shield sensors 190, and as previously disclosed. The controller 132 of the vest 14, 16 or the shield controller 188 can be configured to send a signal to play preprogramed audio through the speaker 130 of a user's vest 14, or the user's opponent's vest 16 when the target pads on the arm shields 160 and leg shields 164 are depressed or contacted, as detected by the shield sensor 190 in the shield 160. The audio that is played can be predetermined based on a selected style of game play and the desired message.

In one embodiment, the target pads in each shield accessory can be coupled to the shield sensor 190. When the target pad is depressed, it can be detected at the shield sensor 190. The shield sensor 188 can send a signal to the shield controller 188 in the shield accessory 160, 164. The shield controller 188 can then send a signal via the shield transceiver 186 to either the first controller 132 in the first wearable vest 14 or the second controller 132 in the second wearable vest 16. The respective wearable vest can then play a predetermined audio file at the speaker 130 indicating that the target pad of the shield accessory was depressed. In one example, the audio can be associated with a specific shield accessory, or a shield accessory that is worn at a specific location, such as a right arm, left arm, right leg, or left leg shield.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

Various techniques, or certain aspects or portions thereof, can take the form of program code (i.e., instructions) embodied in tangible media, such as floppy diskettes, compact disc-read-only memory (CD-ROMs), hard drives, non-transitory computer readable storage medium, or any other machine-readable storage medium wherein, when the program code is loaded into and executed by a machine, such as a computer, the machine becomes an apparatus for practicing the various techniques. Circuitry can include hardware, firmware, program code, executable code, computer instructions, and/or software. A non-transitory computer readable storage medium can be a computer readable storage medium that does not include signal. In the case of program code execution on programmable computers, the computing device can include a processor, a storage medium readable by the processor (including volatile and non-volatile memory and/or storage elements), at least one input device, and at least one output device. The volatile and non-volatile memory and/or storage elements can be a random-access memory (RAM), erasable programmable read only memory (EPROM), flash drive, optical drive, magnetic hard drive, solid state drive, or other medium for storing electronic data. One or more programs that can implement or utilize the various techniques described herein can use an application programming interface (API), reusable controls, and the like. Such programs can be implemented in a high level procedural or object oriented programming language to communicate with a computer system. However, the program(s) can be implemented in assembly or machine language, if desired. In any case, the language can be a compiled or interpreted language, and combined with hardware implementations.

As used herein, the term processor can include general purpose processors, specialized processors such as VLSI, FPGAs, or other types of specialized processors, as well as base band processors used in transceivers to send, receive, and process wireless communications.

It should be understood that many of the functional units described in this specification have been labeled as modules, in order to more particularly emphasize their implementation independence. For example, a module can be implemented as a hardware circuit comprising custom very-large-scale integration (VLSI) circuits or gate arrays, off-the-shelf semiconductors such as logic chips, transistors, or other discrete components. A module can also be implemented in programmable hardware devices such as field programmable gate arrays, programmable array logic, programmable logic devices or the like.

In one example, multiple hardware circuits or multiple processors can be used to implement the functional units described in this specification. For example, a first hardware circuit or a first processor can be used to perform processing operations and a second hardware circuit or a second processor (e.g., a transceiver or a baseband processor) can be used to communicate with other entities. The first hardware circuit and the second hardware circuit can be incorporated into a single hardware circuit, or alternatively, the first hardware circuit and the second hardware circuit can be separate hardware circuits.

Modules can also be implemented in software for execution by various types of processors. An identified module of executable code can, for instance, comprise one or more physical or logical blocks of computer instructions, which can, for instance, be organized as an object, procedure, or function. Nevertheless, the executables of an identified module need not be physically located together, but can comprise disparate instructions stored in different locations which, when joined logically together, comprise the module and achieve the stated purpose for the module.

Indeed, a module of executable code can be a single instruction, or many instructions, and can even be distributed over several different code segments, among different programs, and across several memory devices. Similarly, operational data can be identified and illustrated herein within modules, and can be embodied in any suitable form and organized within any suitable type of data structure. The operational data can be collected as a single data set, or can be distributed over different locations including over different storage devices, and can exist, at least partially, merely as electronic signals on a system or network. The modules can be passive or active, including agents operable to perform desired functions.

Reference throughout this specification to "an example" or "exemplary" means that a particular feature, structure, or characteristic described in connection with the example is included in at least one embodiment of the present invention. Thus, appearances of the phrases "in an example" or the word "exemplary" in various places throughout this specification are not necessarily all referring to the same embodiment.

As used herein, a plurality of items, structural elements, compositional elements, and/or materials can be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention can be referred to herein along with alternatives for the various components thereof. It is understood that such embodiments, examples, and alternatives are not to be construed as defacto equivalents of one another, but are to be considered as separate and autonomous representations of the present invention.

Furthermore, the described features, structures, or characteristics can be combined in any suitable manner in one or more embodiments. In the following description, numerous specific details are provided, such as examples of layouts, distances, network examples, etc., to provide a thorough understanding of embodiments of the invention. One skilled in the relevant art will recognize, however, that the invention can be practiced without one or more of the specific details, or with other methods, components, layouts, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A boxing game system comprising:

a first wearable vest comprising:

a first wireless transceiver;

a first controller coupled to the first wireless transceiver; and a first breast plate having a first plurality of lightable target pads, wherein each lightable target pad includes a sensor and a light that are each coupled to the first controller;

a second wearable vest comprising:

a second wireless transceiver configured to communicate with the first wireless transceiver in the first wearable vest;

a second controller coupled to the second wireless transceiver;

a second breast plate having a second plurality of lightable target pads wherein each lightable target pad includes a sensor and a light that are each coupled to the second controller; and wherein the first controller of the first wearable vest is configured to communicate with the second controller of the second wearable vest via the first wireless transceiver and the second wireless transceiver, respectively.

2. The boxing game system of claim 1, wherein the first wearable vest and the second wearable vest each include an audio speaker coupled to the first controller and the second controller, respectively.

3. The boxing game system of claim 1, wherein one of the first controller or the second controller is configured to activate a predetermined game when a sensor of a selected lightable target pad of the first plurality of lightable target pads and the second plurality of lightable target pads is activated.

4. The boxing game system of claim 3, wherein the predetermined game is a first game activated by the first controller at the first wearable vest, and the first controller is configured to:

activate a light in each of the first lightable target pads in the first wearable vest;

activate a timer at the first wearable vest;

divide the first game into a plurality of rounds using the timer;

detect when each of the sensors coupled to the lightable target pads in the first wearable vest are deactivated and turn off a corresponding light in the lightable target pad for a selected period of time using the timer;

play an identified sound on a speaker of the first wearable vest based on which of the first lightable target pads are depressed, and a number of the first lightable target pads that have been depressed on the first wearable vest within a selected time period; and send a selected indication to the first wireless transceiver for communication to the second controller via the second wireless transceiver, to enable the second controller to perform a selected function at the second wearable vest based on the selected indication, wherein the selected indication is determined based on which of the first lightable target pads are depressed, and a number of the first lightable target pads that have been depressed on the first wearable vest within the selected time period.

5. The boxing game system of claim 4, wherein the selected function comprises:

playing an identified sound in a speaker of the second wearable vest, wherein the sound is identified based on the selected indication.

6. The boxing game system of claim 1, further comprising:

a first set of straps coupled to the first wearable vest configured to attach the first breast plate to a first person's torso; and a second set of straps coupled to the second wearable vest configured to attach the second breast plate to a second person's torso.

7. The boxing game system of claim 1, further comprising one or more pairs of boxing gloves, wherein the first and second plurality of lightable target pads are sized relative to a knuckle portion of the boxing gloves.

8. The boxing game system of claim 1, wherein the first breast plate and the second breast plate are constructed of a rigid housing.

9. The boxing game system of claim 8, wherein:

the rigid housing of the first breast plate is constructed to contain the first controller, the first transceiver, and a battery supply sized to power the first transceiver, the first controller, and the light for each lightable target pad in the first plurality of lightable target pads; and the rigid housing of the second breast plate is constructed to contain the second controller, the second transceiver, and a battery supply sized to power the second transceiver, the second controller, and the light for each lightable target pad in the second plurality of lightable target pads.

10. The boxing game system of claim 9, wherein:

the rigid housing of the first breast plate includes a perimeter wall transverse to a front of the first breast plate with a switch mounted on the perimeter wall, the switch coupled to the battery supply to turn power on and off to the first breast plate; and the rigid housing of the second breast plate includes a perimeter wall transverse to a front of the second breast plate with a switch mounted on the perimeter wall, the switch coupled to the battery supply to turn power on and off to the second breast plate.

11. The boxing game system of claim 1, wherein:

the first plurality of lightable target pads on the first breast plate includes:

a first lightable target pad in an upper middle region on a front of the first breast plate;

a second lightable target pad in a left center region on the front of the first breast plate;

a third lightable target pad in a right center region opposite the second lightable target pad on the front of the first breast plate; and a fourth lightable target pad on a bottom middle region opposite the first lightable target pad on the front of the first breast plate; and the second plurality of lightable target pads on the second breast plate includes:

a first lightable target pad in an upper middle region on a front of the second breast plate;

a second lightable target pad in a left center region on the front of the second breast plate;

a third lightable target pad in a right center region opposite the second lightable target pad on the front of the second breast plate; and a fourth lightable target pad on a bottom middle region opposite the first lightable target pad on the front of the second breast plate.

12. The boxing game system of claim 1, wherein the lightable target pads in the first plurality of lightable target pads and the second plurality of lightable target pads are comprised of:

a displaceable target pad coupled to a spring to allow the target pad to be depressed inwards toward a front of the first breast plate or the second breast plate; and the sensor configured to be activated when the displaceable target pad is depressed by one or more of a hand, a foot, or a boxing glove; or a deformable target pad to allow the target pad to be deformed inwards towards a front of the first breast plate or the second breast plate; and the sensor configured to be activated when the deformable target is deformed by one or more of a hand, a foot, or a boxing glove.

13. The boxing game system of claim 1, wherein:

the first plurality of lightable target pads on the first breast plate are oriented transverse to one another and to face outwardly with respect to a middle of the first breast plate; and the second plurality of lightable target pads on the second breast plate are oriented transverse to one another and to face outwardly with respect to a middle of the second breast plate.

14. The boxing game system of claim 1, further comprising:

a first plurality of raised panels protruding from the first breast plate and circumscribing the first plurality of lightable target pads, respectively; and a second plurality of raised panels protruding from the second breast plate and circumscribing the second plurality of lightable target pads, respectively.

15. The boxing game system of claim 1, wherein each of the first and second plurality of lightable target pads further comprises:

an aperture in the breast plate circumscribed by a perimeter wall transverse to the breast plate;

a retainer secured to the breast plate behind the aperture and having a perimeter wall parallel to and spaced-apart from the perimeter wall of the aperture defining a perimeter gap;

at least one switch carried by the retainer and contactable by the lightable target pad, defining the sensor;

at least one bias member carried by the retainer to bias the lightable target pad away from the switch;

the light carried by the retainer; and the lightable target pad having a perimeter wall movable in the perimeter gap between the retainer and the aperture, and having a flange circumscribing the perimeter wall sized larger than the aperture.

16. The boxing game system of claim 15, wherein the retainer, the at least one switch, the at least one bias member, and the light are separate and discrete from other lightable target pads.

17. The boxing game system of claim 1, wherein each of the first and second plurality of lightable target pads further comprises:

a sleeve carried by the breast plate behind the lightable target pad;

a switch at a bottom of the sleeve;

a bias member in the sleeve;

a post carried by the lightable target pad and movably received in the sleeve to contact the switch while being biased away from the switch by the bias member.

18. The boxing game system of claim 1, wherein the first and second wearable vests have at least three modes of operation, comprising:

a boxing mode in which all of the first and second plurality of lightable target pads are lit but turn off when hit and then relight after a predetermined time period;

an advanced mode in which each first and second plurality of lightable target pads are lit individually and sequentially or randomly until hit or until a predetermined time period or both; and a training mode in which all of the first and second plurality of lightable target pads are lit but turn off when hit and then relight immediately.

19. The boxing game system of claim 1, wherein each of the first and second wearable vests further comprise:

a depressible volume button coupled to a controller, the depressible volume button configured to toggle a volume of audio emitted from an audio speaker of the wearable vests between a selected low level and a selected high level when the depressible volume button is depressed for a selected period of time.

20. The boxing game system of claim 19, wherein the controller is further configured to send a score of a current game to enable the score be played as audio on the audio speaker when the depressible volume button is depressed for a time period that is less than the selected period of time.

21. The boxing game system of claim 1, further comprising:

a shield accessory comprising:

a shield controller;

a shield sensor coupled to the shield controller;

a shield target pad coupled to the shield sensor; and a shield wireless transceiver configured to communicate with the first wireless transceiver or the second wireless transceiver via the shield controller to communicate when the shield target pad is depressed based on a signal from the shield sensor.

22. The boxing game system of claim 21, wherein the shield target pad further includes a light coupled to the shield sensor, wherein the light is activated or deactivated by the shield controller when the shield target pad is depressed based on the signal from the shield sensor.

23. The boxing game system of claim 21, wherein the shield accessory is configured to be worn on a user's arm or a user's leg.

24. The boxing game system of claim 21, wherein the shield controller is configured to send a signal, via the shield wireless transceiver, to one of the first controller or the second controller to play a prerecorded audio at a speaker of the first wearable vest or the second wearable vest when the shield target pad is depressed.

25. A method for using the boxing game system of claim 1, the method comprising:

instructing to don the first and second wearable vests;

instructing to turn on each of the first and second wearable vests;

instructing to pair the first and second wearable vests by instructing to press one of the first plurality of lightable target pads on the first breast plate and a same lightable target pad on the second breast plate to select a same mode on the first and the second wearable vests.

26. A boxing game system comprising:

a first wearable vest comprising:

a first wireless transceiver;

a first controller coupled to the first wireless transceiver;

a first audio speaker coupled to the first controller;

a first breast plate having a first plurality of lightable target pads, wherein each lightable target pad includes a sensor and a light that are each coupled to the first controller; and a first set of straps coupled to the first wearable vest configured to attach the first breast plate to a first person's torso;

a first pair of boxing gloves, wherein the first plurality of lightable target pads are sized relative to a knuckle portion of the first pair of boxing gloves;

a second wearable vest comprising:

a second wireless transceiver configured to communicate with the first wireless transceiver in the first wearable vest;

a second controller coupled to the second wireless transceiver;

a second audio speaker coupled to the second controller a second breast plate having a second plurality of lightable target pads wherein each lightable target pad includes a sensor and a light that are each coupled to the second controller; and a second set of straps coupled to the second wearable vest configured to attach the second breast plate to a second person's torso;

a second pair of boxing gloves, wherein the second plurality of lightable target pads are sized relative to a knuckle portion of the boxing second pair of boxing gloves; and wherein the first controller of the first wearable vest is configured to communicate with the second controller of the second wearable vest via the first wireless transceiver and the second wireless transceiver, respectively.

* * * * *